US005893556A

United States Patent [19]

Akahane et al.

[11] Patent Number: 5,893,556

[45] Date of Patent: Apr. 13, 1999

[54] PRINTER SHEET FEEDER

[75] Inventors: Takashi Akahane; Kiyoto Komuro, both of Nagano, Japan

[73] Assignee: Seiko Epson Corporation, Tokyo-to, Japan

[21] Appl. No.: 08/659,790

[22] Filed: Jun. 6, 1996

[30] Foreign Application Priority Data

Jun. 9, 1995 [JP] Japan ..... 7-167928

[51] Int. Cl.[6] ..... B65H 1/08

[52] U.S. Cl. ..... 271/126; 271/160

[58] Field of Search ..... 271/160, 162, 271/164, 171, 126, 127

[56] References Cited

U.S. PATENT DOCUMENTS

| | | | |
|---|---|---|---|
| 4,632,380 | 12/1986 | Ono | 271/127 |
| 4,874,159 | 10/1989 | Maeno et al. . | |
| 5,238,238 | 8/1993 | Shinohara et al. . | |

FOREIGN PATENT DOCUMENTS

| | | | |
|---|---|---|---|
| 0 386 737 A2 | 9/1980 | European Pat. Off. . | |
| 171936 | 9/1985 | Japan | 271/160 |
| 300024 | 12/1988 | Japan | 271/162 |
| 3-272921 | 12/1991 | Japan . | |
| 159929 | 6/1992 | Japan | 271/160 |
| 621129 | 9/1994 | Japan . | |
| 2199566 | 11/1987 | United Kingdom . | |

OTHER PUBLICATIONS

2381 Xerox Disclosure Journal May/Jun. 17, (1992), No. 3.

*Primary Examiner*—Boris Milef
*Attorney, Agent, or Firm*—Stroock & Stroock & Lavan LLP

[57] ABSTRACT

A printer is provided in which even if short sheets are fed therethrough, these sheets are properly fed and are prevented from twisting during a sheet feed operation. Thus a paper jam caused by a defective sheet feed operation can be prevented. The printer includes sheet feed rollers, a hopper that is retractable with respect to the sheet feed rollers 21, the hopper urging a sheet to be printed upon toward the sheet feed rollers 21, and a link that insures the hopper moves in parallel with the sheet feed rollers when retracted, and when even short sheets are placed within the hopper.

16 Claims, 8 Drawing Sheets

PRINTER SHEET FEEDER

BACKGROUND OF THE INVENTION

1. Field of the intention

This invention is related generally to a printer, and more particularly to the improvement of a sheet feed section thereof.

2. Related art

One known sheet feeder used for a conventional printer is disclosed in unexamined Japanese Patent Publication No. Hei. 3-272921 as shown in FIG. 10. The sheet feeder has a hopper table 1 for maintaining a plurality of sheets thereon and three sheet feed rollers 4 for feeding each of the plurality of sheets maintained on hopper table 1. A bottom plate 3, serves as a hopper and is supported by a plurality of springs 2 disposed between bottom plate 3 and hopper table 1, serving as resilient members. Bottom plate 3 is arranged at a portion of hopper table 1 confronting sheet feed rollers 4.

A plurality of sheets S are held on hopper table 1 and are urged toward sheet feed rollers 4 by bottom plate 3, which is itself urged toward sheet feed rollers 4 by the biasing force of springs 2. Each of sheets S is fed toward a print section of a printer (not shown) through the force exerted thereon by the rotation of sheet feed rollers 4.

Since bottom plate 3 supported by springs 2 is arranged at the portion of hopper table 1 confronting sheet feed rollers 4, an edge portion of sheets S confronting and parallel to sheet feed rollers 4 is elevated and urged toward sheet feed rollers 4, so as to extend along sheet feed rollers 4, as shown in FIG. 11. As a result, even if hopper table 1 is not maintained precisely parallel with respect to sheet feed rollers 4, the upper surface of each of sheets S can be maintained in parallel with sheet feed rollers 4. This prevents each of sheets S from contacting less than all of sheet feed rollers 4, and therefore insures that each of sheets S is fed straight and properly by all of sheet feed rollers 4.

While this conventional sheet feeder for a printer has been satisfactory, the following inconvenience has been encountered when sheets S1 whose width is narrower than that of bottom plate 3 are placed on hopper table 1. As shown in FIG. 12, when sheets S1 such as postcards or envelopes or the like whose width is narrower than that of hopper table 1 are placed on hopper table 1 , a side H1 of hopper table 1, holding sheets S1, is maintained at a lower level with respect to a side H2 where no sheets SE are held because sheets S1 force side H1 of hopper table 1 against the bias force of springs 4 while side H2 of hopper table 1 is not so urged. That is, side H2 which holds no sheets S1 rises to a higher level than side H1 which holds sheets S1. Thus, sheet feed rollers 4 come into contact with sheets S1 on an angle with respect to the plane of the sheet S1. As a result, sheets S1 are susceptible to being fed improperly and twisting when being fed. This in turn tends to cause a paper jam because of this defective sheet feed operation.

Thus, it is desired to provide a printer in which even a narrow sheet will be properly fed and will not twist during a sheet feed operation, and in which a paper jam or the like due to this defective sheet feed operation can be prevented.

SUMMARY OF THE INVENTION

Generally speaking, in accordance with the invention, a printer is provided, including a sheet feed roller, a hopper for urging a sheet toward the sheet feed roller and a link for moving the hopper with respect to the sheet feed roller, the link insuring that the hopper is maintained in parallel with the sheet feed roller. The link of the invention further includes a first rotary shaft, a plurality second rotary shafts, and a pair of arm portions. The first rotary shaft is rotatably coupled to either a frame of the printer main body or the hopper and is positioned in parallel with an axial line of the sheet feed roller. The plurality of the second rotary shafts are arranged in parallel with the first rotary shaft while positioned a predetermined distance from the first rotary shaft and are rotatably coupled to the hopper or the frame of the printer main body. The pair of arm portions are fixed to the first rotary shaft so as not to be rotatable relative to the first rotary shaft and couple the first rotary shaft to the second rotary shafts. The link is formed into a substantially flattened U-shaped structure in plan view.

Furthermore, either the first rotary shaft or the second rotary shaft coupled to the hopper substantially on a line orthogonal to an upper surface of the hopper and the axis of the rollers lie on the line. A biasing force for urging the hopper is applied in a direction towards the axis of the sheet feed roller substantially along the line orthogonal to the upper surface of the hopper.

In a preferred embodiment, the printer sheet feeder has a hopper for urging a sheet toward the sheet feed roller, and a link for moving the hopper with respect to the sheet feed roller, the link insuring that the hopper is maintained in parallel with the sheet feed roller at all times even if the hopper is advanced or retracted from the sheet feed rollers.

If sheets whose width is narrower than the width of the hopper are placed on the hopper, the sheets will be situated against one side of the hopper. If so placed across the width of the hopper in a conventional printer, the side of the hopper on which the sheets are placed is maintained at a lower level with respect to the side where no sheets are held. Thus, the side on which no sheets are held rises to a higher level with respect to the side of the hopper on which the sheets are placed. However, the printer sheet feeder of the present invention allows the hopper to retract under the force of the sheets while maintaining the hopper essentially parallel with respect to the sheet feed roller. Therefore, the side of the hopper on which no sheets are held is maintained at the same level as the side of the hopper upon which sheets are held. Thus, both sides of the hopper can uniformly be arranged in parallel with the sheet feed roller regardless of the size of the sheet placed within the hopper.

That is, even if sheets whose width is narrower than the width of the hopper are placed on one side of the hopper across the width of the hopper, the hopper, and thus the sheets placed in the hopper, can be maintained in parallel with respect to the sheet feed roller. Thus, the sheet feed roller will always properly come into contact with the sheets. Thus, sheets will be properly fed and will not be likely to twist during a sheet feted operation, and a paper jam of sheets or the like due to a defective sheet feed operation can be prevented.

The link of the invention further includes a first rotary shaft, a plurality of second rotary shafts, and a pair of arm portions. The first rotary shaft is rotatably coupled to a frame of the printer main body or the hopper and is positioned parallel with an axial line of the sheet feed roller. The plurality of second rotary shafts are arranged in parallel with tie first rotary shaft while positioned a predetermined distance from the first rotary shaft and are rotatably coupled to the hopper or the frame of the printer main body. The pair of arm portions are fixed to the first rotary shaft so as not to be rotatable relative to the first rotary shaft. The link is formed into a substantially flattened U-shaped structure.

Therefore, the link can be easily formed. For example, the link may be formed by bending a single piece of wirelike member, thereby allowing the link to be easily formed at a low cost.

In addition, the pair of arm portions are designed to be fixed to the first rotary shaft so as to be unrotatable relative to the first rotary shaft. Therefore, even if the link is not formed of a single piece of wirelike member but rather is formed by combining a plurality separate member together, each of the two arm portions will rotate with the same displacement in the same direction at all times. Thus, the hopper and the sheet feed rollers can be maintained in parallel more reliably.

Furthermore, the first rotary shaft or the second rotary shaft are coupled to the hopper on a line orthogonal to an upper surface of the hopper, the orthogonal line passing through the axis of the sheet feed rollers. A biasing force for urging the hopper is applied toward the axis of the sheet feed roller substantially along the orthogonal line. Therefore, the direction in which the first rotary shaft or the second rotary shafts are displaced when the hopper is urged to retract from the sheet feed roller is substantially aligned with the direction in which the hopper urging force is applied. Thus, the displacement of any portion of the hopper results in a displacement of the entire hopper, including portion of the hopper to which the first rotary shaft or the second rotary shaft are coupled, even if a force is not applied to that portion of the hopper. Therefore, the first rotary shaft or the second rotary shaft are less susceptible to flexing and are less likely to allow the hopper to move unevenly, which in turn allows the hopper to be maintained in parallel with the sheet feed rollers at all times.

If the first rotary shaft or the second rotary shafts are not coupled to the hopper substantially on the line including the axis, but rather are coupled at a position largely deviating from this line, the displacement of the portion of the hopper at which the urging force is applied and the displacement of the portion of the hopper to which the first rotary shaft or the second rotary shaft are coupled, and to which no urging force is applied, tend to be different due to the negative flexing effects of the hopper. This in turn makes it hard to correctly transmit the displacement of a portion of the hopper through to the first rotary shaft or the second rotary shafts, and thereafter to the entire hopper. Thus, in the invention, the first rotary shaft or the second rotary shafts are coupled to the hopper substantially on the line including the axis of the sheet feed rollers. Therefore, the first rotary shaft or the second rotary shaft are less susceptible to negative flexing effects, which in turn allows the hopper to be maintained in parallel with the sheet feed rollers.

Accordingly, it is an object of the invention to provide an improved hopper for a printer which overcomes the deficiencies of the prior art.

Another object of the invention is to provide an improved hopper for a printer in which narrow sheets of paper will be properly fed from the hopper.

A further object of that invention is to provide an improved hopper for a printer in which even if narrow sheets of paper are put into the hopper, the sheet feed rollers will be maintained in parallel with the sheets and hopper, and these sheets will be properly fed.

Still other objects and advantages of the invention will in part be obvious and will in part be apparent from the specifications and drawings.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description in connection with the accompanying drawings, in which.

DETAILED DESCRIPTION OF THE PREFERRED EMBODIMENTS

Figure 1:
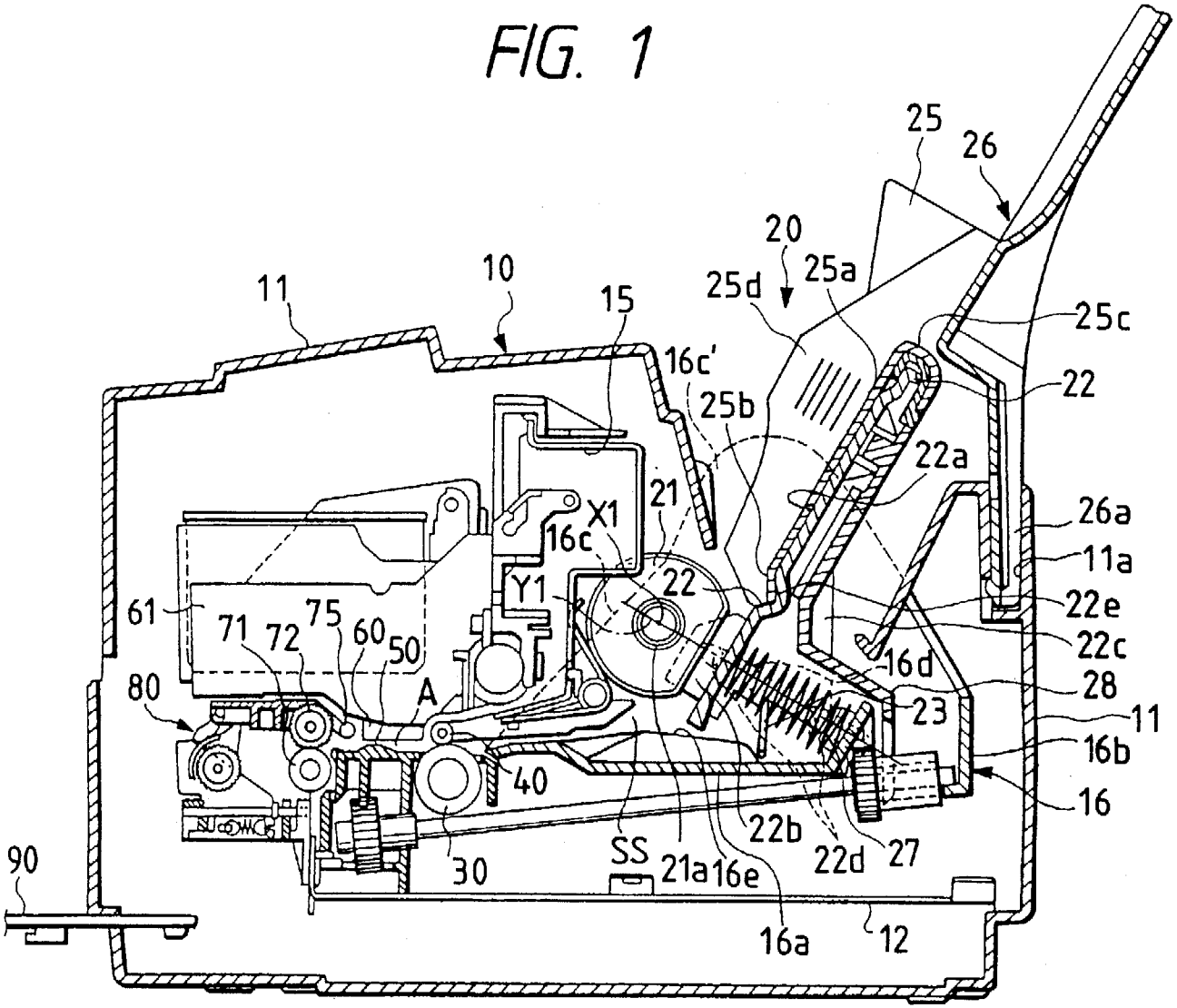
FIG. 1 is; a side cross-sectional view of a printer constructed in accordance with the invention.

Reference is first made to FIG. 1, in which a printer main body is formed with a case 11 and an automatic sheet feeder 20 incorporated within main body 10.

Figure 4:
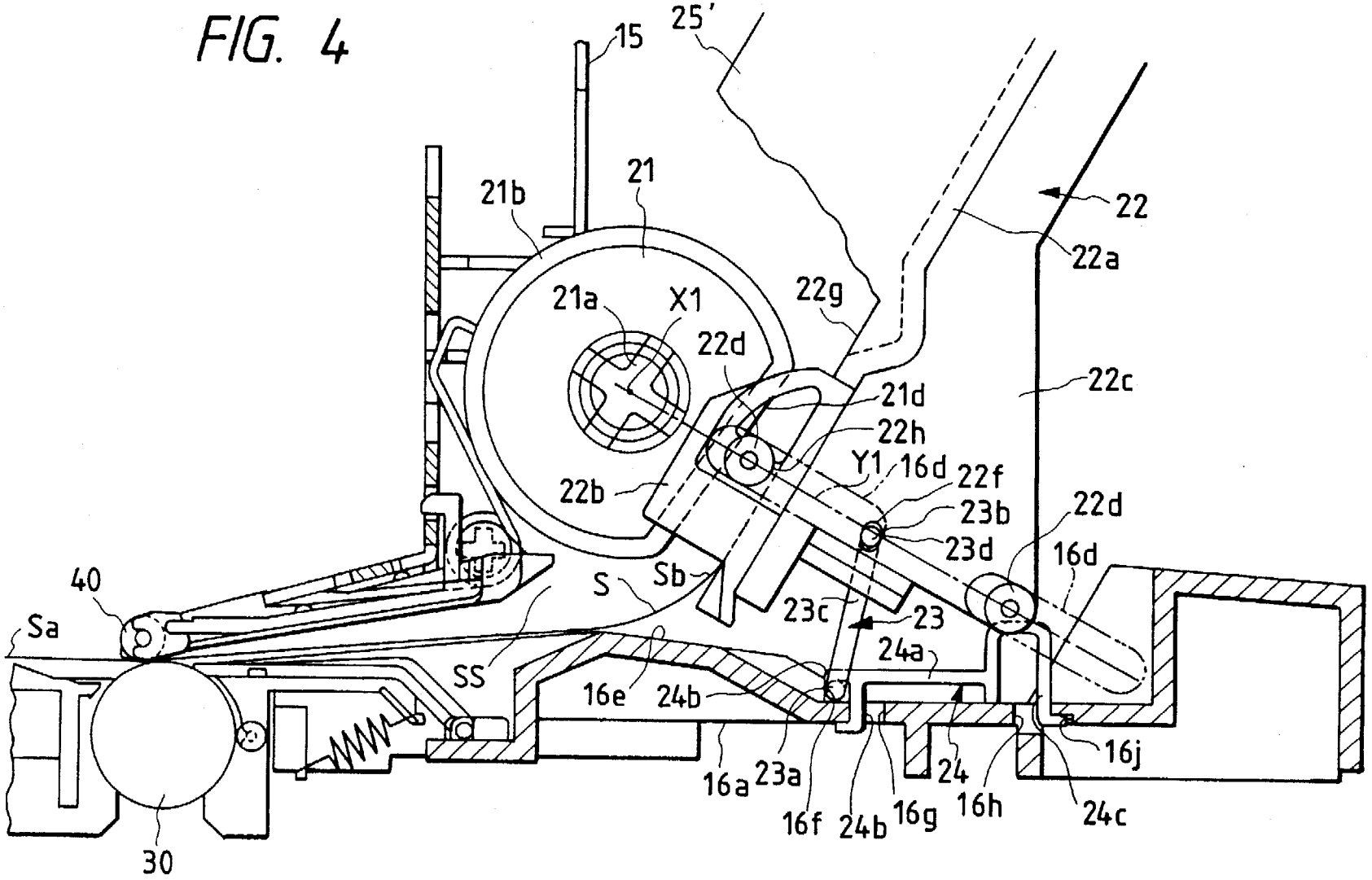
FIG. 4 is an enlarged partial side elevational view of the printer of FIG. 1.

Referring next to FIG. 4, in addition to FIG. 1, a sheet feed path SS, through which a sheet of papers fed by automatic sheet feeder 20 passes, is shown. At least one sheet forward roller 30 is mounted within printer body 10 downstream of automatic sheet feeder 20 along sheet feed path SS. A pinch roller 40 is maintained in pressure contact with sheet forward roller 30 and is driven to rotate thereby. A regulating member 50 adapted to guide a back end of sheet S is disposed downstream of rollers 30, 40 along sheet feed path SS. A carriage 61 is supported within casing 11 and supports an ink jet head 60 and the like mounted thereon to perform a print operation by ejecting ink droplets onto a sheet S. A guide roller 75 positioned downstream of ink jet head 60 guides sheet S along sheet feed path SS. A pair of sheet discharge rollers 71, 72 are disposed between guide roller 75 and a sheet discharge section 80. Further, fixed to a front of main body 10 a sheet discharge tray 90 is provided on which discharged sheets are stacked after they have been printed upon.

As shown in FIG. 4, sheet S is fed by automatic sheet feeder 20 and contacts sheet forward roller 30 along sheet feed path SS. Sheet feed path SS is concavely curved as viewed in FIGS. 1 and 4. Sheet S is further forwarded by sheet forward roller 30 with the angle of forwarding of sheet S being regulated by the positioning of pinch roller 40. Thus sheet S has its front end Sa and its back end Sb guided by regulating member 50 while essentially at all times being in contact with the upper surface of regulating member 50. Regulating member 50 also acts as a guide member so that the distance between sheet S and ink jet head 60 is maintained at a constant, predetermined value. As a result, ink is properly ejected from head 60 onto a front surface of sheet S at a printer area A. Sheet S, after being printed upon, is then discharged onto sheet discharge tray 90 via the pair of sheet feed rollers, 71, 72 and sheet discharge section 80.

Figure 2:
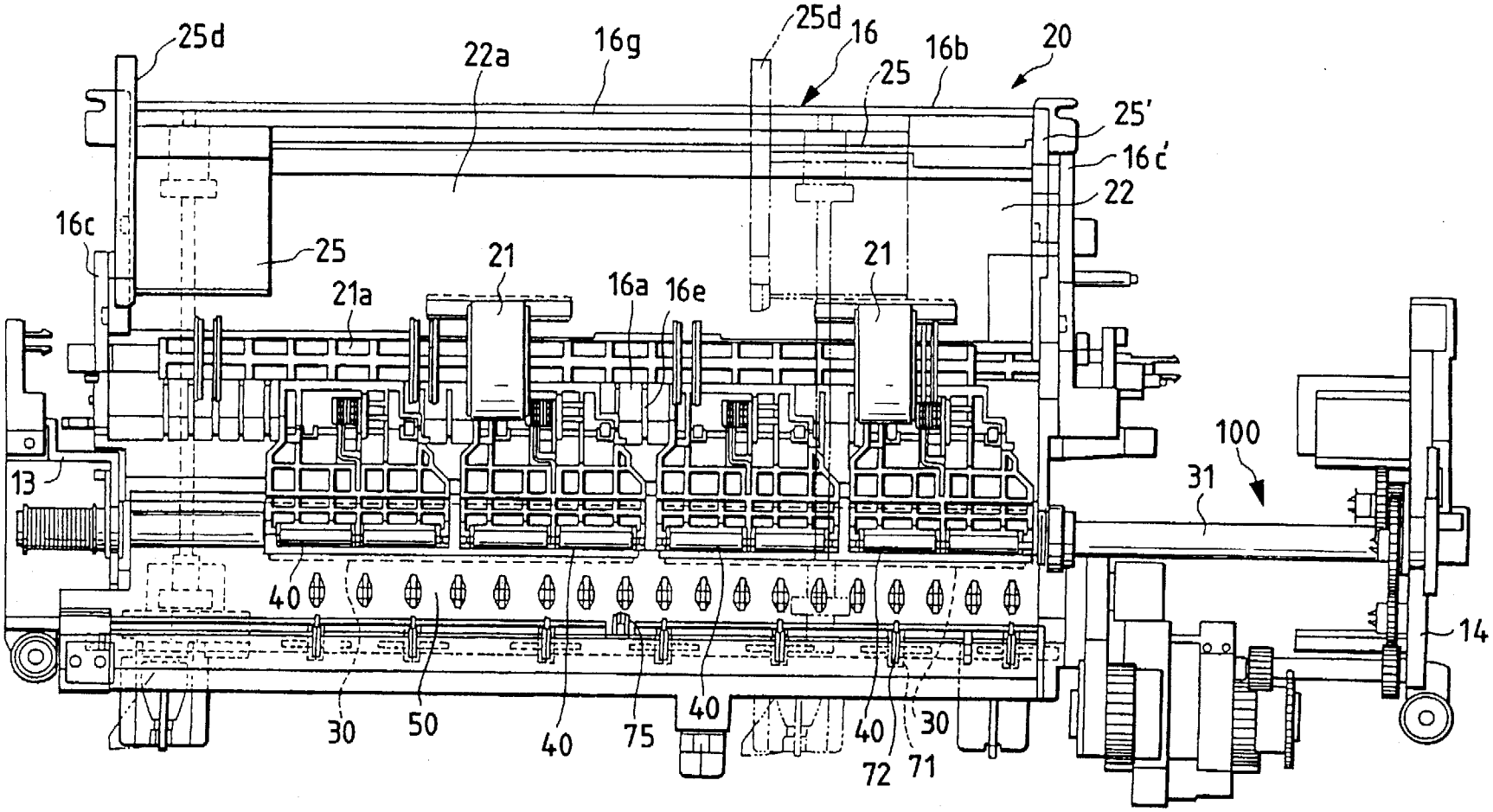
FIG. 2 is a partial top plan view of the printer of FIG. 1.

Referring next to FIGS. 1 and 2, details of automatic sheet feeder 20, sheet forward roller 30, and pinch roller 40 will be described. Main body 10 is formed with a bottom frame 12, side frames 13, 14, and intermediate frame 15, and a subframe 16 within case 11. In a preferred embodiment, bottom frame 12 is formed of a metal plate and serves also as a shield plate inside casting 11. Right and left side frames 13, 14, which are formed of plastic, are positioned adjacent the left and rights sides of the bottom frame 12 and extend orthogonally thereto. Intermediate frame 15 bridges between side frames 13, 14 and is formed of a metal plate. Subframe 16 is formed of plastic, is secured to frames 13, 14 and is dimensioned to allow many of the internal components of the printer to be fixed thereto.

Additionally, as shown in FIGS. 1–3 and 6, subframe 16 further includes a bottom plate **16*a*, a back plate 16*b*, and side plates 16*c*, 16*c*'. Bottom plate 16*a* forms a lower portion of sheet path SS. Back plate 16*b* is formed integrally with bottom plate 16*a* at a back edge thereof. Side plates 16*c*, 16*c*' are also formed integrally with bottom plate 16*a* and with back plate 16*b* at each end thereof. Thus, bottom plate 16*a*, back plate 16*b*, and side plates 16*c*, 16*c*' are all formed integrally with each other. A rib-like sheet guide 16*e* is formed on a top surface of bottom plate 16*a***.

Automatic sheet feeder 20 is also formed with a hopper 22, a link 23 received by hopper 22, edge guides 25, 25' formed on either side of hopper 22 and a sheet feed tray 26 maintained in casing 11 adjacent hopper 22. A grooved sheet feed roller shaft **21*a* is rotatably supported by side plates 16*c*, 16*c*' of subframe 16. Sheet feed rollers 21 are fixedly mounted on sheet feed roller shaft 21*a*. Each sheet feed roller 21 is formed with a D-shaped cross-section that includes a straight face 21*d* and an arcuate face 21*b* and is further formed with a rubber-coated surface. Sheet feed roller shaft 21*a* is driven to rotate by a transmission mechanism that interlocks with a drive mechanism 100 during a sheet feed operation. Hopper 22 is designed so as to be retractable from sheet feed rollers 21 and urges a sheet toward sheet feed rollers 21**.

Figure 6:
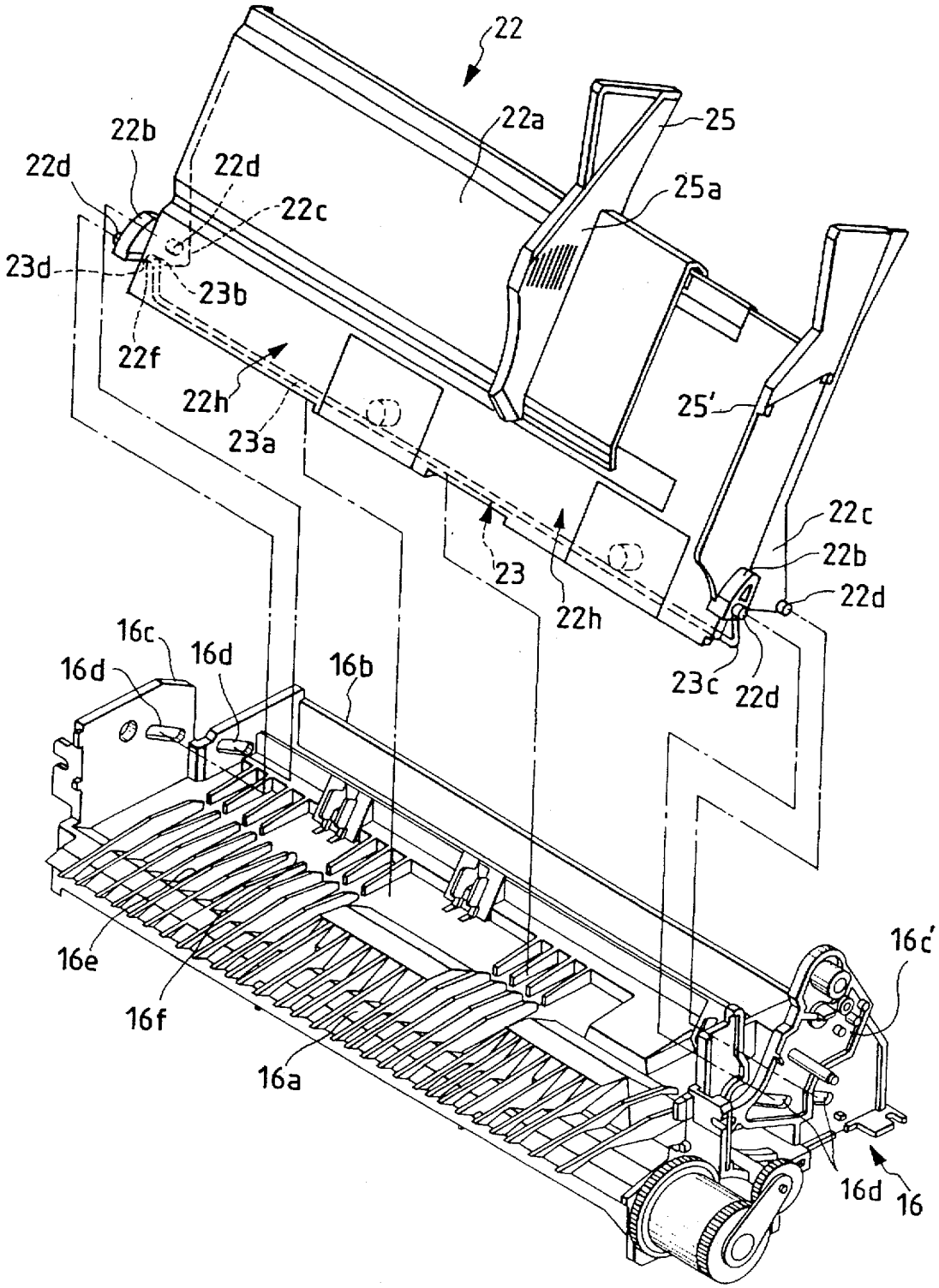
FIG. 6 is an exploded perspective view of the subframe and a hopper constructed in accordance with the invention.

As shown in FIG. 6, hopper 22 is formed of a bottom plate **22*a*, side plates 22*b*, 22*b* formed on either side thereof, triangular side plates 22*c*, 22*c* formed on either side of bottom plate 22*a* and four pins 22*d* extending in pairs from opposite sides of bottom plate 22*a*. Bottom plate 22*a* supports the bottom surface of sheet S. Side plates 22*b* are formed integrally with bottom plate 22*a* so as to extend away from bottom plate 22*a* on either side thereof. Triangular side plates 22*c*, 22*c* are also formed integrally with bottom plate 22*a* so as to extend orthogonally from bottom plate 22*a* on either side thereof. The four pins 22*d*, project away from bottom plate 22*a* and are formed in pairs integral with a respective side plate 22*b*, 22*c*. Pins 22*d*, engage a pair of elongated holes 16*d*, 16*d* formed in side plates 16*c*, 16*c*' of subframe 16 to allow hopper 22** to be mounted so as to be retractable.

As shown in FIG. 4, the centerline of elongated hole **16*d* in the longitudinal direction is designed to pass through an axial line X1 (seen end on in FIG. 4) of sheet feed rollers 21, and is superposed on a line Y1 that is orthogonal to a front surface 22*g* of hopper 22, i.e. hole 16*d* lies along a line substantially orthogonal to hopper bottom plate 22*a*, and the axis of roller shaft 21*a* lies on a plane line formed by this orthogonal line arid hopper bottom plate 22*a*; line Y1 intersects line X1. As a result of this construction, when retracted, hopper 22 retracts along the line Y1 and in a predetermined direction with respect to sheet feed rollers 21**.

Figure 7:
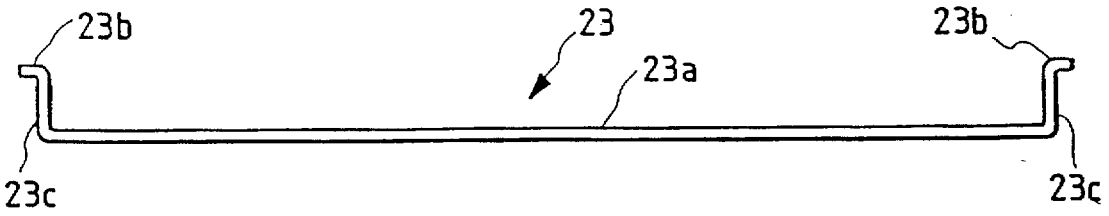
FIG. 7 is a top plan view of a link constructed in accordance with the invention.

As shown in FIG. 7, link 23 has a substantially flattened U-shaped structure as viewed from above, and includes a first rotary shaft **23*a*, second rotary shafts 23*b*, 23*b*, and a pair of arm portions 23*c*, 23*c*. In a preferred embodiment, link 23** is formed by bending a single piece of a rigid wirelike member.

Figure 3:
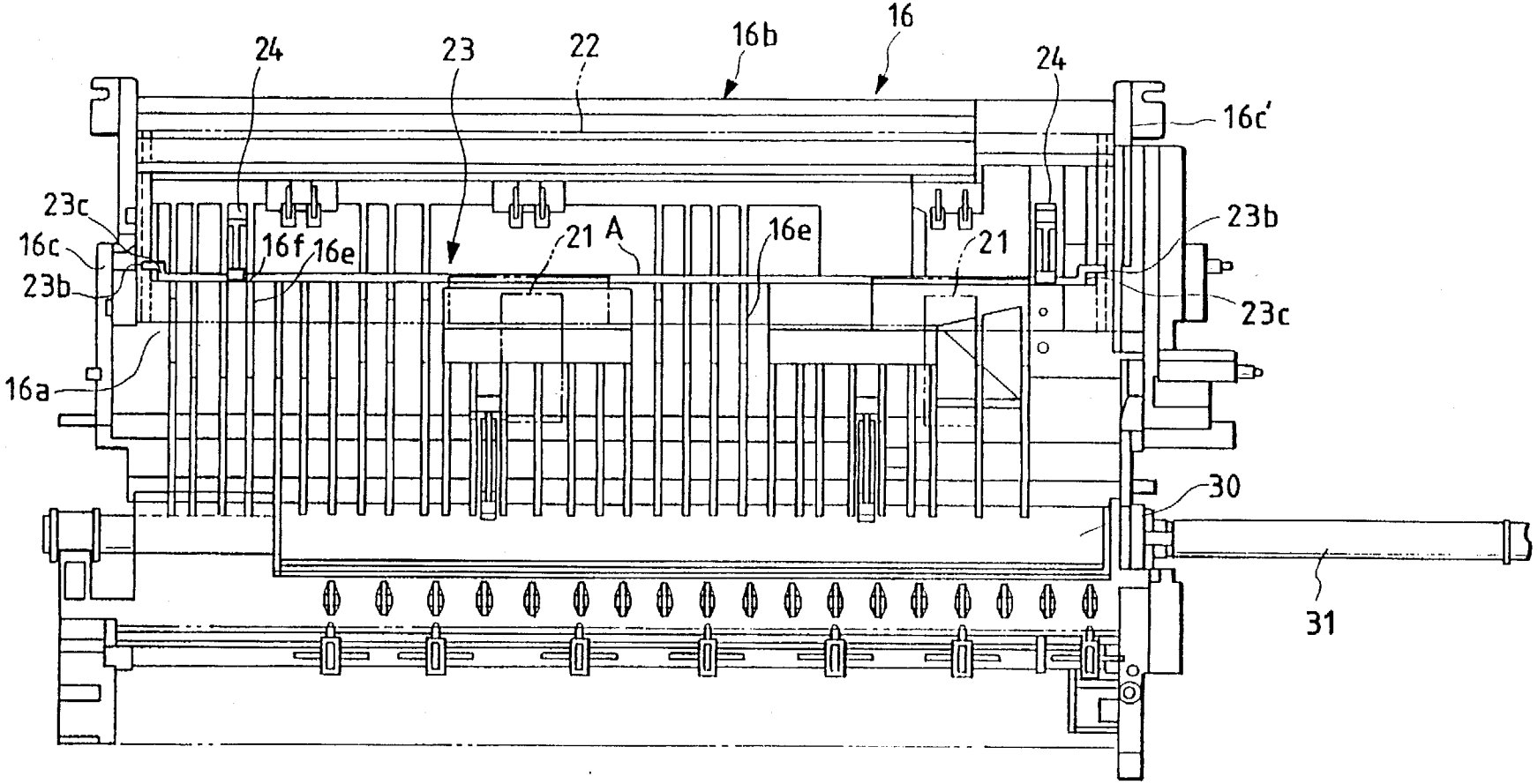
FIG. 3 is a partial top plan view of the printer of FIG. 1 with a bottom plate of a subframe exposed.

As shown in FIGS. 3 and 4, the first rotary shaft **23*a* is slightly shorter than the width of hopper 22 and is rotatably coupled to stepped portions 16*f* arranged on bottom plate 16*a* of subframe 16 and are clamped by mounting pieces 24. First rotary shaft 23*a* is coupled to stepped portions 16*f* of bottom plate 16*a* and extends, as shown in FIG. 4, in parallel with the axial line X1 of sheet feed rollers 21**.

As is further shown in FIG. 4, each mounting piece 24 is formed with a base portion **24*a* and a piece 24*b* arranged on one end of base portion 24*a*. Piece 24*b* has an inverted flattened U-shaped structure as viewed from the side and the lower portion thereof is inserted into and engages an engagement hole 16*g* formed in bottom plate 16*a* of the subframe 16 so that first rotary shaft 23*a* of link 23 can be clamped between piece 24*b* and stepped portions 16*f*. A spring piece 24*c* is arranged on the other end of base portion 24*a*. The lower portion of spring piece 24 is inserted into and engages an engagement hole 16*h* formed in bottom plate 16*a* of subframe 16 so that piece 24*b* is urged toward stepped portion 16*f*. First rotary shaft 23*a* of link 23 is clamped toward stepped portion 16*f* by the biasing force of spring piece 24*c*. In a preferred embodiment, two mounting pieces 24 are arranged at two positions, each one close to one end of first rotary shaft 23*a* of link 23**.

As shown in FIG. 7, second rotary shafts **23*b*, 23*b* are arranged in parallel with first rotary shaft 23*a* on a respective arm 23*c*, 23*c*. As is further shown in FIGS. 4 and 6, second rotary shafts 23*b*, 23*b* have respective end portions 23*d*, 23*d* thereof engaged with small elongated holes 22*f*, 22*f* formed in respective side plates 22*c*, 22*c* of hopper 22 so as to be rotatably coupled to hopper 22. As shown in FIG. 4, small elongated hole 22*f*** is arranged substantially on line Y1 so as to extend in a direction orthogonal to line Y1.

As shown in FIG. 1, a hopper spring 27 is positioned between hopper 22 and bottom plate **16*a* of subframe 16. Hopper spring 27 biases hopper 22 toward the axial line X1 of sheet feed rollers 21. Hopper spring 27 is positioned to apply a biasing force toward axial line X1 of sheet feed rollers 21 substantially along line Y1. An additional hopper spring 27 is positioned at each location corresponding to the location of each sheet feed roller 21. A cam mechanism (not shown) is arranged on sheet feed roller shaft 21*a*. The cam mechanism is designed to hold hopper 22 against the biasing forces of hopper springs 27. Hopper 22 is designed to release sheet S when straight face 21*a* of sheet feed roller 21 opposes it. That is, during a sheet feed operation, the holding force generated by the cam mechanism or hopper 22 is released, and sheet S is urged by the biasing forces of hopper springs 27, so as to be biased onto sheet feed rollers 21*a***.

When a sheet feed operation is completed the holding force of the cam mechanism is restored and hopper 22 is pressed down by the cam mechanism so that sheet S is no longer maintained in contact with sheet feed rollers 21.

Edge guide 25 is further formed with a bottom plate 25*a*, a bent portion 25*b* arranged on the front end portion of bottom plate 25*a*, a clip portion 25*c* arranged on the rear end portion of bottom plate 25*a*, and a side plate 25*d*. Edge guide 25 is slidably mounted so as to be slidable with respect to hopper 22. Bent portion 25*b* is engaged with a groove 22*e* of hopper 22. Clip portion 25*c* resiliently clamps the rear portion (the upper end portion as shown in FIG. 1) of hopper 22 so as to enclose this rear portion. Edge guide 25 and more specifically side plate 25*d*, serves to guide the left side of a sheet S (not shown) set on hopper 22 in FIG. 2. The right side of sheet S is guided by an inner side surface 25' formed integral with bottom plate 22*a* of hopper 22 (see FIG. 6).

As shown in FIG. 1, sheet feed tray 26 is releasably mounted on main body 10 by inserting an insertion piece 26*a* formed on the lower portion of sheet feed tray 26 into an insertion hole 11*a* formed in case 11 of main body 10 so that sheet feed tray 26 is detachably mounted on printer body 10. Sheet feed tray 26 is designed to support the bottom surface of sheet S in cooperation with hopper 22 when mounted on the main body 10.

It is relatively easy to place a plurality of sheets onto sheet feeder 20. Since hopper 22 is pressed down against the bias force of spring 27 by the holding force of the cam mechanism, the plurality of sheets may be easily placed within sheet feeder 20 when automatic sheet feeder 20 is not in operation by placing a plurality of sheets into the hopper from above. When automatic sheet feeder 20 is operated and a plurality of sheets are set therein, hopper 22 is first elevated when the holding force of the cam mechanism is released. This allows the uppermost sheet P of the plurality of sheets held on hopper 22 to be fed into sheet feed path SS upon coming in contact with, and being urged by sheet feed rollers 21.

As shown in FIG. 3, sheet forward roller 30 is elongated round rodlike rubber roller that are coaxially fixed to a sheet forward roller shaft 31. Sheet forward roller shaft 31 is supported between side frames 13, 14 and is driven to rotate by drive mechanism 100. Sheet P is thereafter forward by sheet forward roller 30 a predetermined distance after a print operation has been performed by head 60.

The following advantages can be obtained by the thus constructed printer.

When the printer is operated after a plurality of sheets S have been set along both hopper 22 and sheet feed tray 26, automatic sheet feeder 20 is operated to elevate hopper 22 and thereby urge a sheet toward sheet feed rollers 21. Since link 23 is arranged between hopper 22 and subframe 16, hopper 22 retracts as follows: First rotary shaft 23*a* of link 23 is arranged in parallel with axial line X1 of sheet feed rollers 21. Second rotary shafts 23*b*, 23*b* are arranged in parallel with first rotary shaft 23*a* through arm portions 23*c*, 23*c*. Therefore, second rotary shafts 23*b*, 23*b* are always arranged in parallel with axial line X1 of sheet feed rollers 21. Hence, hopper 22, coupled to link 23, is maintained in parallel with respect to sheet feed rollers 21 at all times.

Figure 8:
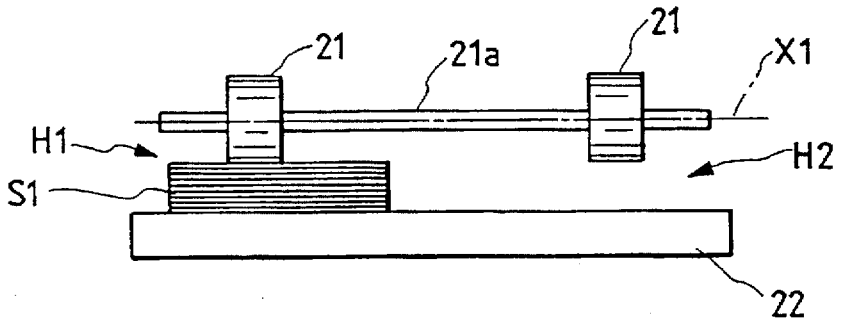
FIG. 8 depicts the operation of a hopper constructed in accordance with the invention.

As shown in FIG. 8, when a plurality of sheets S1 such as postcards or Envelopes or the like whose width is narrower than the width of hopper 22 are placed on hopper 22, only a side H1 of hopper on which sheets S1 are placed has a downward force exerted thereon. A side H2 that does not hold any sheets is susceptible to being urged by spring 27 (not shown) upward in FIG. 8. However, in accordance with the invention, side H1, loaded with a plurality of sheets S1, is displaced as a result of sheets S. As a result, unloaded side H2 is also uniformly displaced through the operation of link 23. Therefore, side H2 with no sheets held thereon moves in parallel with side H1, and loaded side H1 and unloaded side H2 are maintained in parallel with sheet feed rollers 21 at all times.

Thus, even if sheets S1 whose width is narrower than the width of hopper 22 are placed toward one side of hopper 22 in the width direction, hopper 22 and sheet feed rollers 21 are maintained in parallel at all times, thus preventing sheet feed roller 21 from contacting sheets S1 improperly. Thus, according to the printer constructed in accordance with the invention, sheets S1 are not twisted while being fed from hopper 22, and therefore a paper jam due to a defective sheet feed operation can be prevented.

Second rotary shafts 23*b*, 23*b* coupled to hopper 22 are substantially on line Y1 that is situated orthogonal to upper surface 22*g* of hopper 22, line Y1 passing through axial line X1 of sheet feed rollers 21. Therefore, parallelism with axial line X1 of sheet feed rollers 21 can be maintained in the most crucial portions of hopper 22, i.e. in the portions confronting axial line X1 of sheet feed rollers 21 (denoted as reference character 22*h* in FIGS. 4 and 6).

The urging force on hopper 22 is directed toward axial line X1 of sheet feed rollers 21 in the direction along which line Y1 extends. Therefore, a direction in which second rotary shafts 23*b*, 23*b* are displaced at the time hopper 22 retracts with respect to sheet feed rollers 21 is substantially aligned with the direction in which the urging force on hopper 22 is applied. This in turn makes a displacement of the portion of hopper 22 at which the hopper is urged by sheets or the like substantially equal to the displacement of the portions of hopper 22 to which second rotary shafts 23*b*, 23*b* are coupled. Hence, second rotary shafts 23*b*, 23*b* are less susceptible to negative flexing effects of hopper 22, which allows hopper 22 to be maintainers more precisely parallel to sheet feed rollers 21.

Figure 9:
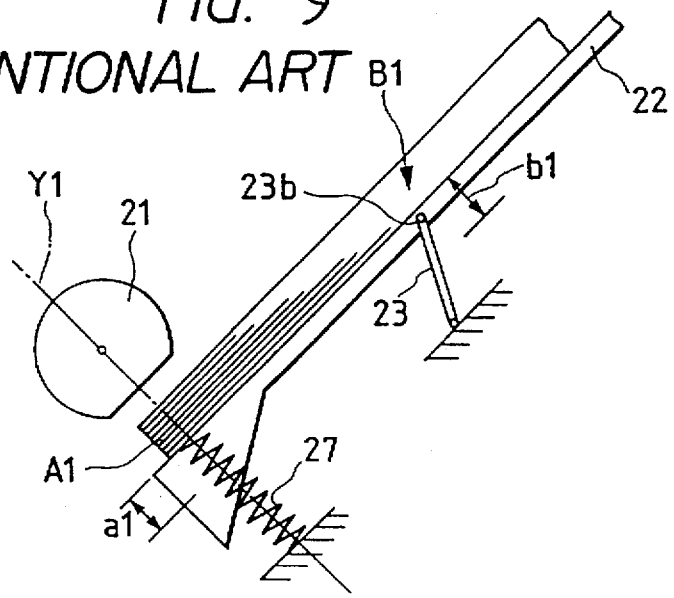
FIG. 9 CONVENTIONAL ART
FIG. 9 depicts the hypothetical operation of a hopper which is not constructed in accordance with the conventional art.
Figure 10:
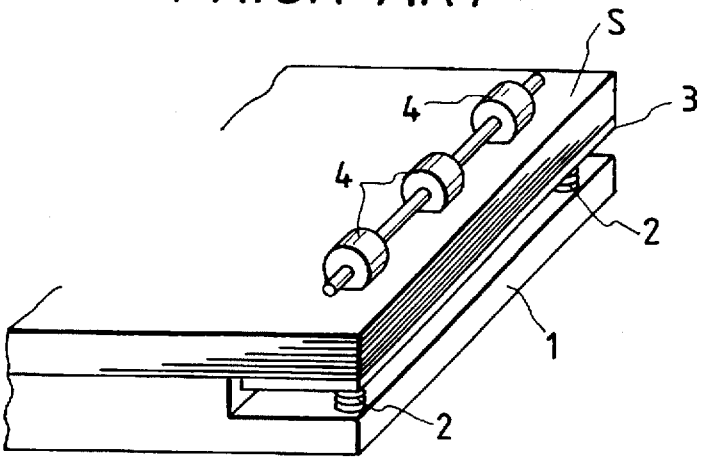
FIG. 10 PRIOR ART
FIG. 10 is a perspective view of a conventional printer.
Figure 11:
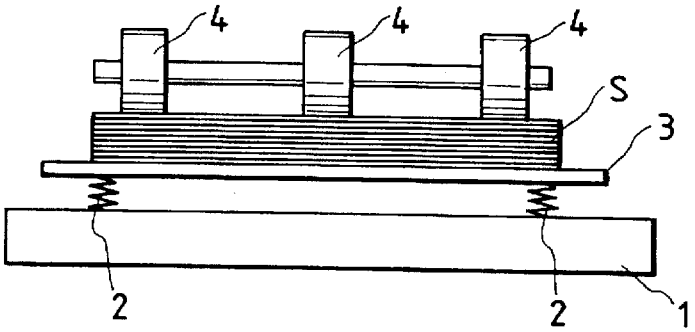
FIG. 11 PRIOR ART
FIG. 11 is a side elevational view of a conventional printer.
Figure 12:
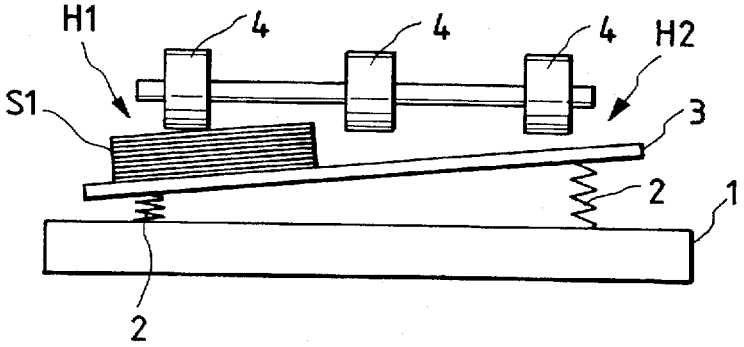
FIG. 12 PRIOR ART
FIG. 12 is a side elevational view of a conventional printer.

As shown in FIG. 9, if second rotary shafts 23*b*, 23*b* are not coupled to the hopper 22 substantially on line Y1 in accordance with the invention, but rather are coupled to hopper 22 at a position different than line Y1, then a portion A1 to which an urging force is applied and a portion B1 to which second rotary shafts 23*b*, 23*b* are coupled will have different displacements a1, b1 respectively due to negative flexing effects of hopper 22. As a result, the displacement at portion A1, to which the urging force is applied, is difficult to properly transmit to second rotary shaft 23*b*. Thus, in accordance with the invention, rotary shafts 23*b*, 23*b* are coupled substantially on line Y1 and, therefore, are less susceptible to negative flexing effects of hopper 22. As a result, the hopper 22 can be maintained in parallel with sheet feed rollers 21.

Further, link 23 for moving hopper 22 in a substantially parallel fashion is designed to have a substantially flattened U-shaped structure as viewed from top. This construction is easily formed at a reduced cost by bending a single unitary wirelike metal member.

Figures 5, 13:
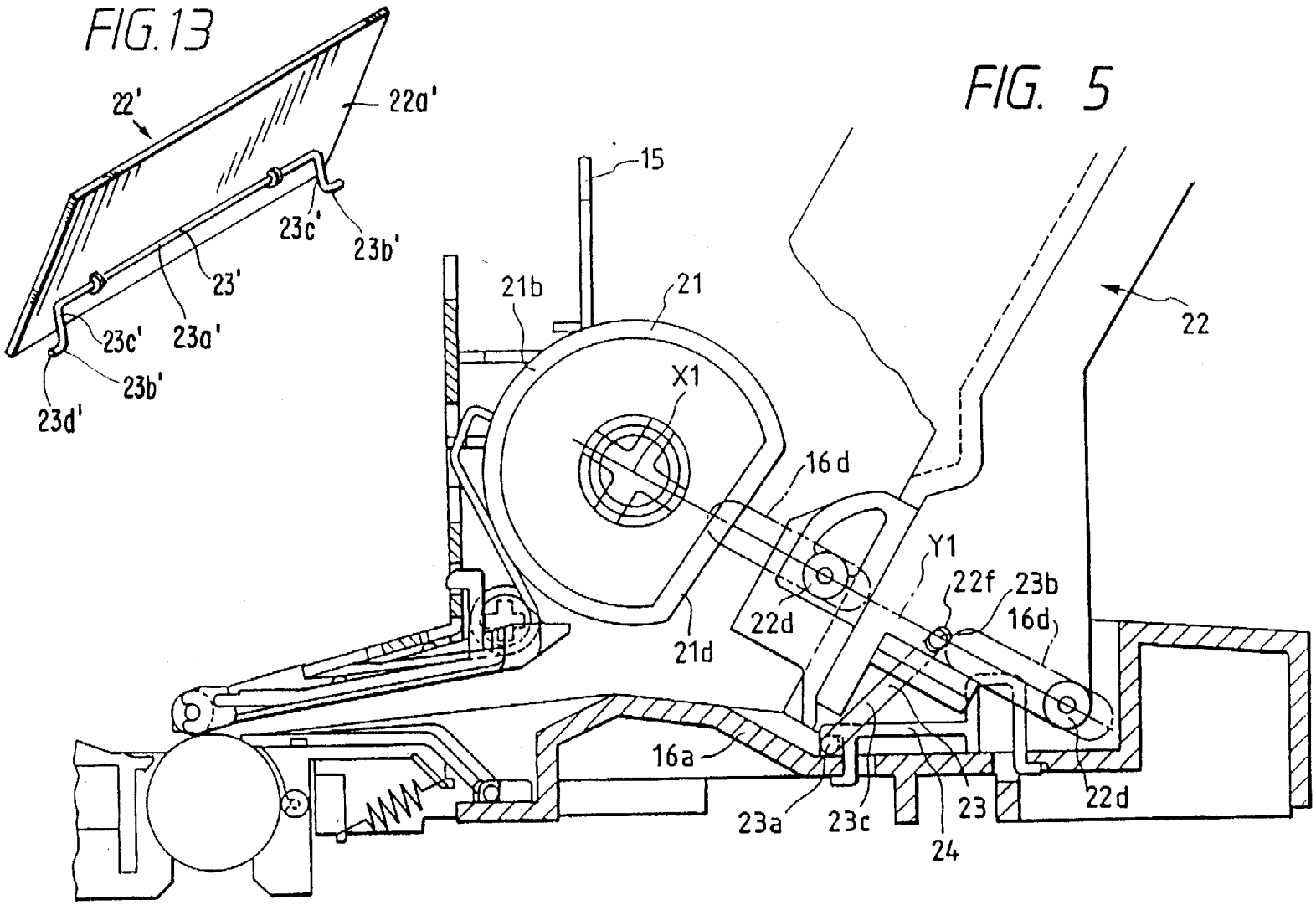
FIG. 5 is a partial side elevational view of the printer of FIG. 1 showing the hopper shifted in accordance with the invention.
FIG. 13 is a perspective view of the subframe, hopper and link constructed in accordance with a second embodiment of the invention.

In a second embodiment of the invention shown in FIG. 13, a link 23' may be constructed so that a first rotary shaft 23*a'* is rotatably coupled to a hopper 22' and second rotary shafts 23*b'*, 23*b'* are rotatably coupled to bottom plate 16*a* (FIG. 6). In such an embodiment, hopper 22' is constructed in a manner similar to hopper 22. That is, second rotary shafts 23*b'*, 23*b'*, which have respective end portions 23*d'*, 23d', are coupled to first rotary shaft 23a' by a pair of arm portions 23c', 23c'. Thus, as compared to link 23 depicted in FIG. 6, link 23' is rotated 180°. The advantages provided by the first embodiment, however, are also realized in the second embodiment.

Further, link 23 is not limited to being formed by bending a single piece of a unitary wirelike member as in the first embodiment. Rather link 23 may also be formed by combining a plurality of separate members into a substantially flattened U-shaped structure as viewed from top, as long as the combination comprises at least a first rotary shaft, second rotary shafts, and a pair of portions. The first rotary shaft is still rotatably coupled to the frame of printer main body 10 or hopper 22 and is arranged to extend in parallel with axial line X1 of sheet feed rollers 21. The second rotary shafts are still arranged in parallel with the first rotary shaft while being positioned a predetermined distance therefrom, and are rotatably coupled to hopper 22 or frame 11 of printer main body 10. The pair of arm portions is still fixed to the first rotary shaft so as not to be rotatable relative to the first rotary shaft and are designed to the couple first rotary shaft to the second rotary shafts.

The printer thus constructed in accordance with the invention provides the advantage of preventing a paper jam of sheets or the like because of a defective sheet feed operation when small sheets are to be printed upon.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A printer, comprising:

a printer frame;

a sheet feed roller fixed within said printer frame for feeding a sheet to be printed in a sheet feed direction;

a hopper having a plate with an upper surface opposing said sheet feed roller for urging a sheet toward said sheet feeder roller, said hopper slidably coupled to said printer frame along a line substantially orthogonal to said sheet feed direction; and a link rotatably fixed to said frame and rotatably fixed to said hopper along the line substantially orthogonal to said sheet feed direction for insuring said upper surface of said hopper is maintained substantially parallel to said sheet feed roller during any movement of said hopper.

2. The printer of claim 1, wherein said link includes:

a first rotary shaft;

a pair of arms extending essentially perpendicularly to said first rotary shaft, said pair of arms each being fixed to a respective end of said first rotary shaft; and a pair of second rotary shafts, each fixed to the free end of each of said pair of arms, said pair of second rotary shafts being disposed essentially parallel with said first rotary shaft while being distanced from said first rotary shaft a predetermined distance.

3. The printer of claim 2, wherein said first rotary shaft is rotatably coupled to said printer frame.

4. The printer of claim 3, wherein said pair of second rotary shafts is rotatably coupled to said hopper.

5. The printer of claim 4, wherein said first rotary shaft is arranged in parallel with an axial line of said sheet feed roller.

6. The printer of claim 5, wherein said pair of second rotary shafts pass along a line substantially orthogonal to an upper surface of said hopper, said substantially orthogonal line to an upper surface of said hopper intersecting an axial line of said sheet feed roller.

7. The printer of claim 6, further comprising:

a spring member for applying an urging force to said hopper, thereby urging said hopper toward the axial line of said feed roller substantially along the line substantially orthogonal to the upper surface of said hopper.

8. The printer of claim 2, wherein said first rotary shaft is rotatably coupled to said hopper.

9. The printer of claim 8, wherein said pair of second rotary shafts is rotatably coupled to said printer frame.

10. The printer of claim 9, wherein said first rotary shaft is arranged in parallel with an axial line of said sheet feed roller.

11. The printer of claim 10, wherein said first rotary shaft passes along a line orthogonal to an upper surface of said hopper, said substantially orthogonal line to an upper surface of said hopper intersecting an axial line of said sheet feed roller.

12. The printer of claim 11, further comprising:

a spring member for applying a biasing force to said hopper, thereby biasing said hopper toward the axial line of said sheet feed roller substantially along the line orthogonal to the upper surface of said hopper.

13. The printer of claim 2, wherein said pair of arms are fixed to said first rotary shaft and said pair of second rotary shafts so as to be rotatable with said first rotary shaft.

14. The printer of claim 2, wherein said link is formed as a substantially flattened U-shaped structure.

15. A printer, comprising:

a printer frame having a base, a first side having at least one slot, and a second side having at least one slot; each of said first and second sides extending upwardly from said base in a direction parallel to one another;

a sheet feed roller fixed within said printer frame for feeding a sheet to be printed upon in a paper feed direction, said paper feed direction being substantially orthogonal to the lengthwise direction of each of said at least first and second side slots;

a hopper having a plate with an upper surface opposing said sheet feed roller for supporting a sheet, and two side plates formed at either end of said plate, said side plates each having at least one pin projecting outwardly from each side plate for engaging said at least first and second side slots;

a spring extending between said base and said hopper aligned in a direction substantially parallel to said at least first and second side slots for urging said hopper toward said sheet feed roller substantially along the lengthwise direction of each of said at least first and second side slots; and a link rotatably fixed to said frame and rotatably fixed to said hopper for insuring that said upper surface of said hopper is maintained parallel to said sheet feed roller as said hopper moves in a direction orthogonal to said sheet feed direction during any movement of said hopper.

16. The printer of claim 15, wherein said link further comprises a first rotary shaft rotatably fixed to said frame, a pair of arms extending essentially perpendicularly to said first rotary shaft, each arm of said pair of arms being fixed to a respective end of said first rotary shaft, and a pair of second rotary shafts, each fixed to a free end of each of said pair of arms, each of said pair of second rotary shafts being disposed essentially parallel with said first rotary shaft and being rotatably fixed to said hopper.

* * * * *